US010349200B2

(12) United States Patent
Ouborg et al.

(10) Patent No.: US 10,349,200 B2
(45) Date of Patent: Jul. 9, 2019

(54) AUDIO REPRODUCTION SYSTEM COMPRISING SPEAKER MODULES AND CONTROL MODULE

(71) Applicant: OUBORG & GATIN IP B.V., Delft (NL)

(72) Inventors: Jorn Ouborg, Delft (NL); Sten Ouborg, Delft (NL); Florent Gatin, Delft (NL)

(73) Assignee: OUBORG & GATIN IP B.V., Delft (NL)

( * ) Notice: Subject to any disclaimer, the term of this patent is extended or adjusted under 35 U.S.C. 154(b) by 0 days.

(21) Appl. No.: 15/522,876

(22) PCT Filed: Oct. 29, 2015

(86) PCT No.: PCT/NL2015/050756

§ 371 (c)(1),
(2) Date: Apr. 28, 2017

(87) PCT Pub. No.: WO2016/068708

PCT Pub. Date: May 6, 2016

(65) Prior Publication Data

US 2017/0325044 A1 Nov. 9, 2017

(30) Foreign Application Priority Data

Oct. 29, 2014 (NL) ..... 2013704

(51) Int. Cl.

| | |
|---|---|
| ***H04R 3/12*** | (2006.01) |
| ***H04R 5/04*** | (2006.01) |
| ***H04S 7/00*** | (2006.01) |

(52) U.S. Cl.

CPC ..... *H04S 7/303* (2013.01); *H04R 3/12* (2013.01); *H04R 5/04* (2013.01); *H04S 7/302* (2013.01); *H04S 7/308* (2013.01)

(58) Field of Classification Search

USPC ..... 381/17, 81, 103, 300, 303, 85, 310, 111, 381/386, 58

See application file for complete search history.

(56) References Cited

U.S. PATENT DOCUMENTS

| | | | | |
|---|---|---|---|---|
| 6,118,880 | A | 9/2000 | Kokkosoulis et al. | |
| 7,369,879 | B1 * | 5/2008 | Steigerwald ..... | H01Q 1/521 343/851 |

(Continued)

FOREIGN PATENT DOCUMENTS

| | | | | |
|---|---|---|---|---|
| EP | 1 542 503 | * 11/2003 | ..... | H04S 7/00 |
| EP | 1-542-503 | * 11/2003 | ..... | H04S 7/00 |
| EP | 1542503 A1 | 6/2005 | | |

OTHER PUBLICATIONS

Hightower et al.; Spot on: An indoor 3D location sensing technology based on rf signal strenght; UW CSE 00-02-02, University of Washington, Department of Computer Science and Engineering; Seattle, WA; 16 pages retrieved from the interent (http://seattle.intel-research.net/people/jhightower/pubs/hightower2000indoor/hightower2000indoor.pdf); Feb. 18, 2000.

(Continued)

*Primary Examiner* — Yosef K Laekemariam
(74) *Attorney, Agent, or Firm* — Shay Glenn LLP

(57) ABSTRACT

A system comprises multiple speakers and a control unit. The speakers and the control unit are arranged to locate one another and to determine distances and preferably locations relative to one another, for example based on signal power measurements. Also a user position may be determined via a device close to the user, like a telephone or a watch. This information is used for processing audio data for rendering for optimal user experience. Based on locations of speakers relative to the user, dedicated functionality may be assigned to a speaker. The audio data to be reproduced may be processed and at least parts thereof may be assigned to a (Continued)

speaker, depending on the assigned functionality. Speaker modules may be added and assigned a functionality on the go. Capability for processing of audio and position data may be performed by any of a user device, speaker module or dedicated control module.

16 Claims, 6 Drawing Sheets

(56) References Cited

U.S. PATENT DOCUMENTS

| | | | | |
|---|---|---|---|---|
| 2007/0222771 | A1* | 9/2007 | Brask | G06F 1/3218 345/204 |
| 2009/0323991 | A1* | 12/2009 | Hudson | H04S 7/00 381/303 |
| 2013/0170647 | A1* | 7/2013 | Reilly | H04R 27/00 381/17 |
| 2014/0003619 | A1 | 1/2014 | Sannie et al. | |

OTHER PUBLICATIONS

Power Density; 4 pages retrieved from the Internet (http://www.tscm.com/pwr-dens.pdf); on Jul. 24, 2017.

* cited by examiner

AUDIO REPRODUCTION SYSTEM COMPRISING SPEAKER MODULES AND CONTROL MODULE

TECHNICAL AREA

The various aspects relate to configuration of an audio system and to configuration of speaker modules and processing audio data for reproduction in particular.

BACKGROUND

Functionality of speakers of an audio system is usually defined by how the speakers are connected to an amplifier or receiver: the speaker connected to the left rear output terminal of the amplifier is to be the left rear speaker. Furthermore, rendering of input audio data and subsequent reproduction of the audio data is determined by the input data and certain semi-static preferences defined in accordance with system settings, either pre-defined or user selected.

Prior art according to EP-1542503 is acknowledged here, to disclose displacing a sweet spot with movement of a user, employing phase and amplitude adaptation in a fixed speaker device set-up only.

SUMMARY

Such set up is not very flexible with respect to (re-) location of speakers in a room. A user may move through a room and speakers may be relocated in the room. It is preferred to provide a system with various components that provide more flexibility, which may adapt to relocation of modules of the system and/or a listener position.

A first aspect provides, in a system comprising a first speaker device and a second speaker device, a method of processing audio data. The method comprises receiving first position data related to the first speaker device and receiving second position data related to the second speaker device. Based on the first position data, a first distance between a user device and the first speaker device is determined and based on the second position data, a second distance between the user device and the second speaker device is determined. First audio data for reproduction by the first speaker device and second audio data for reproduction by the second speaker device is received. The first audio data and the second audio data are processed by adjusting at least one of the first audio data and the second audio data for compensating for a difference between the first distance and the second distance. Subsequently, the processed first audio data is provided to the first speaker device for reproduction; and the processed second audio data is provided to the second speaker device for reproduction.

By adjusting audio data compensating for distance, a user may be kept in a sweet spot of a speaker system while either relocating himself or herself or while relocating speakers. Volume and phase may be adjusted, reproduction may be delayed and even audio firstly intended for the first speaker may be provided to the second speaker as well- or the other way around.

In an embodiment the method comprises transmitting at least the first and second audio data and determining the first and second position data using different protocols. For example, the protocol used for determining the first and second position data is a short range protocol. More in particular the short range protocol may be Bluetooth. Since Bluetooth has a range of usually approximately 5-10 meters, depending on the environmental circumstances, like building structure and the like, position determination using Bluetooth has a distinct advantage of being able to detect a user when he or she comes in sound range of a speaker, to activate the speaker, and de-activate speakers, when the user moves out of sound range relative to the speakers to be deactivated. The other protocol for transmitting at least the first and second audio data may be based on the WiFi standard 802.11. This has a longer range, but more importantly, has sufficient transmission capacity to include position data in a practically continuous stream of audio data to the speaker devices, when transmitting the first and second position data using the same protocol as the first and second audio data.

In an embodiment the system comprises a control module. The method according to this embodiment comprises establishing transmission of a first signal between the first speaker device and the control module and transmission of a second signal between the second speaker device and the control module. A first signal sending power of the first signal at the sending location of the first signal and a second signal sending power of the second signal at the sending location of the second signal are determined. Furthermore, a first signal receiving power of the first signal at the receiving location of the first signal and a second signal receiving power of the second signal at the receiving location of the second signal are determined. At least part of the first position data is determined by determining a first distance between the control module and the first speaker device based on the first signal sending power and the first signal receiving power; and at least part of the second position data is determined by determining a second distance between the control module and the second speaker device based on the second signal sending power and the second signal receiving power.

This embodiment is particularly advantageous with a wireless speaker system, where such components for wireless transmission are available. Theoretically, the square of the distance is proportional to the power sent divided by the power received, allowing to determine the distance by means of a simple calculation: http://wwwi.tscm.com/pwrdens.pdf. However, in practice, another relation between distance and the ratio of the powers may exist.

Another embodiment comprises, for one or more components of the ensemble of the members of the system and the user device, establishing transmission of at least one further signal between the component and at least one further component. This embodiment further comprises determining a further signal sending power of the further signal at the sending location of the further signal and determining a further signal receiving power of the further signal at the receiving position of the further signal. Furthermore, this embodiment comprises determining a further distance based on the further signal sending power and the further signal receiving power; the further distance being between the component and the further component between which the transmission has been established and, for one or more component of the ensemble of the members of the system and the user device, based on distances between each component on one hand and at least two further components on the other hand, determining position data on relative positions of one or more component of the system and the user device relative to other components of the system.

This enables more components, like more speaker modules, to be identified and located.

A further embodiment comprises for one or more component of the ensemble of the members of the system and the user device, distances between one or more components on one hand and at least three further components on the other hand, wherein the determined position data for each component comprise data on locations of each component of the system relative to at least one other component of the system.

Using additional position data parameters and another distance parameter in particular, specific locations with, for example Cartesian coordinates, may be determined using triangulation.

Yet another embodiment comprises based on the position data of the first speaker device, the second speaker device and at least one of the user device and the control module, assigning a dedicated functionality to the first speaker device and the second speaker device. In prior art methods and systems, a configuration of the system in terms of relative positions of the speaker devices is a given fact. Each speaker has an assigned functionality as the speaker for one of the channels, such as left or right speaker or LF, RF, LR, RR, centre, woofer. This embodiment enables the method and system to adapt to a far greater extent to where the user is in relation to the speaker devices, by assigning variable functionalities to each of the speaker devices. In more detail, a speaker assigned as LF speaker at one time, may be adapted to act as a RR speaker at another time, depending on the relative positions of all speakers in relation to a position of the user. This can be effected relatively easily, by corresponding distribution of parts of input audio signals (for example part of the audio data associated with the the channels of the system) to desired ones of the speakers.

Speaker modules of a speaker system may be relocated anywhere in a room. A speaker connected to a left rear output of an amplifier may be relocated to a left front position—or even to a right front position. By locating the speaker, for example by means of triangulation, relocation may be detected. Subsequently, the left front or right front functionality may be assigned to the relocated speaker. And another speaker may be assigned the functionality of the left rear speaker. However, such relocation is not performed physically; by sending parts of audio data associated with desired channels adaptively to selected speakers having an assigned functionality, which may vary, the system can be entirely reconfigured adaptively and continuously, without actual relocation of speakers, to provide an optimal starting point for subsequent sweet spot following, for example using delays, phase shifts and amplitude variations.

A second aspect provides a processing device for a system for processing audio data. The device comprises a communication module and a processing module. The communication module arranged to receive first position data related to the first speaker device, receive second position data related to the second speaker device, receive first audio data for reproduction by the first speaker device and receive second audio data for reproduction by the second speaker device. The processing module arranged to, based on the first position data, determine a first distance between a user device and the first speaker device, based on the second position data, determine a second distance between the user device and the second speaker device and to process the first audio data and the second audio data by adjusting at least one of the first audio data and the second audio data for compensating for a difference between the first relative distance and the second relative distance. The communication module is further arranged to provide the processed first audio data to the first speaker device for reproduction; and provide the processed second audio data to the second speaker device for reproduction.

A third aspect provides a speaker device forming part of an audio processing system comprising multiple members, the speaker device comprising a speaker for producing sound based on audio data received by the speaker device. The speaker device comprises a communication module arranged to establish transmission of a signal between the speaker device and at least one other member of the audio processing system to communicate signal data based on quality of the established signal enabling a control module comprised by the system to determine distance between the speaker device and the other member; and receive the audio data. The speaker is arranged to render the received audio data by means of the speaker.

A fourth aspect provides a computer programme product comprising computer executable code enabling a processor of a computer, when the code is loaded into the processor, to execute the method according to the first aspect or embodiments thereof.

BRIEF DESCRIPTION OF THE DRAWINGS

The various aspects and embodiments thereof will now be discussed in further detail in conjunction with Figures. In the Figures.

DETAILED DESCRIPTION

Figure 1A:
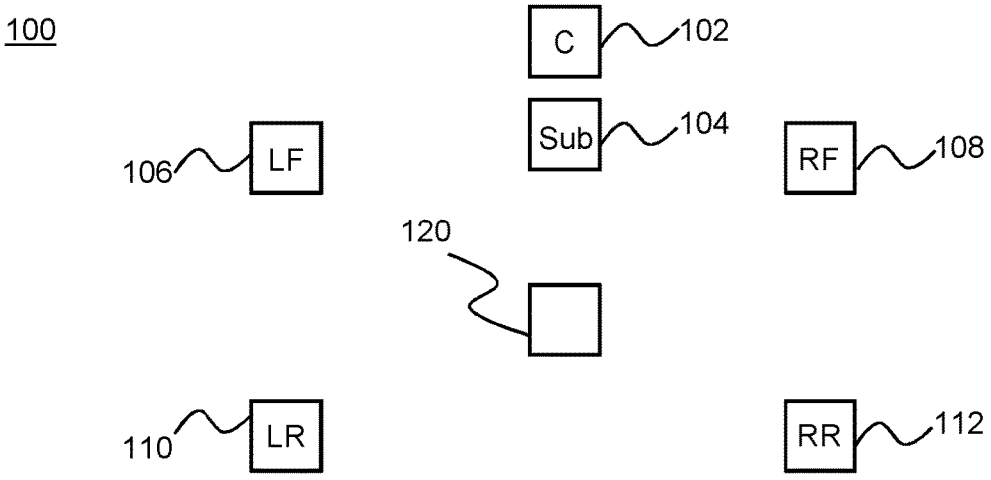
FIG. 1A: shows a first set up of a speaker system.

FIG. 1A shows a schematic view of a spatial distribution of speakers of a speaker set 100 around a listener position 120. A listener is presumed to be located at the listener position 120, facing towards a centre speaker 102. The speakers of the speaker set 100 are distributed in a more or less standard way. The centre speaker 102 is placed with a subwoofer 104 on one axis with the listener position 120. Satellite speakers are placed at more or less the same distances from the listener position 120. In particular a first satellite speaker 106 placed at a left-front position of the listener position 120 at a first distance from the listener position 120. A second satellite speaker 108 is placed at a right-front position of the listener position 120, at the first distance as well.

In this way, the functionality of each of the first and the second satellite speakers is well defined in a so-called 5.1 arrangement: the first speaker 106 is the left front (LF) speaker and the second speaker 108 is the right front (RF) speaker. Likewise, a third satellite speaker 110 and a fourth satellite speaker 112 are provided at equidistant positions from the listener position. In these positions, the third satellite speaker 110 fulfils a left rear (LR) function and the fourth satellite speaker 112 fulfils a right rear (RR) function. The user position 120 is determined in the middle of the system, the so-called sweet spot.

Figure 1B:
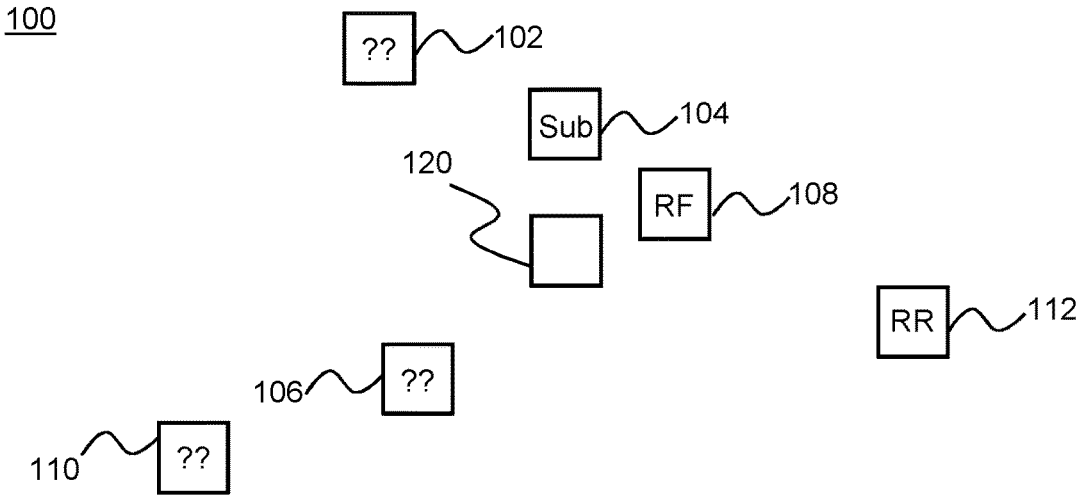
FIG. 1B: shows a second set up of a speaker system.

FIG. 1B shows another schematic view of the speaker set 100 around the listener position. In the set-up shown by FIG. 1B, the various satellite speakers and the centre speaker 102 are positioned at different positions around the listener position 120. This makes it not directly clear what roles the first satellite speaker 106 and the third satellite speaker 110 are to fulfil: left front, left rear, both, or none of these? Furthermore, the user position 120 is not found to be at the sweet spot of the speaker system 100 as depicted by FIG. 1B—if any sweet spot may be defined at all.

In another scenario, a speaker system may start off with only one, two or three satellites, either with or without a centre speaker. In this scenario, one satellite speaker is placed directly left from the listener position 120. Subsequently, a further satellite speaker is added to the speaker system 100, left to the listener position 120 as well. If the further satellite speaker is placed in front of the listener position 120—the front being defined as above—, the further speaker is preferred to act as left front speaker. If the further satellite speaker is placed behind the listener position 120, the further speaker is preferred to act as left rear speaker. The functionality of the speaker is usually defined by how the speakers are connected to an amplifier or receiver: the speaker connected to the left rear output terminal of the amplifier is to be the left rear speaker. Such set up is not very flexible with respect to relocation of speakers in a room.

Figure 2:
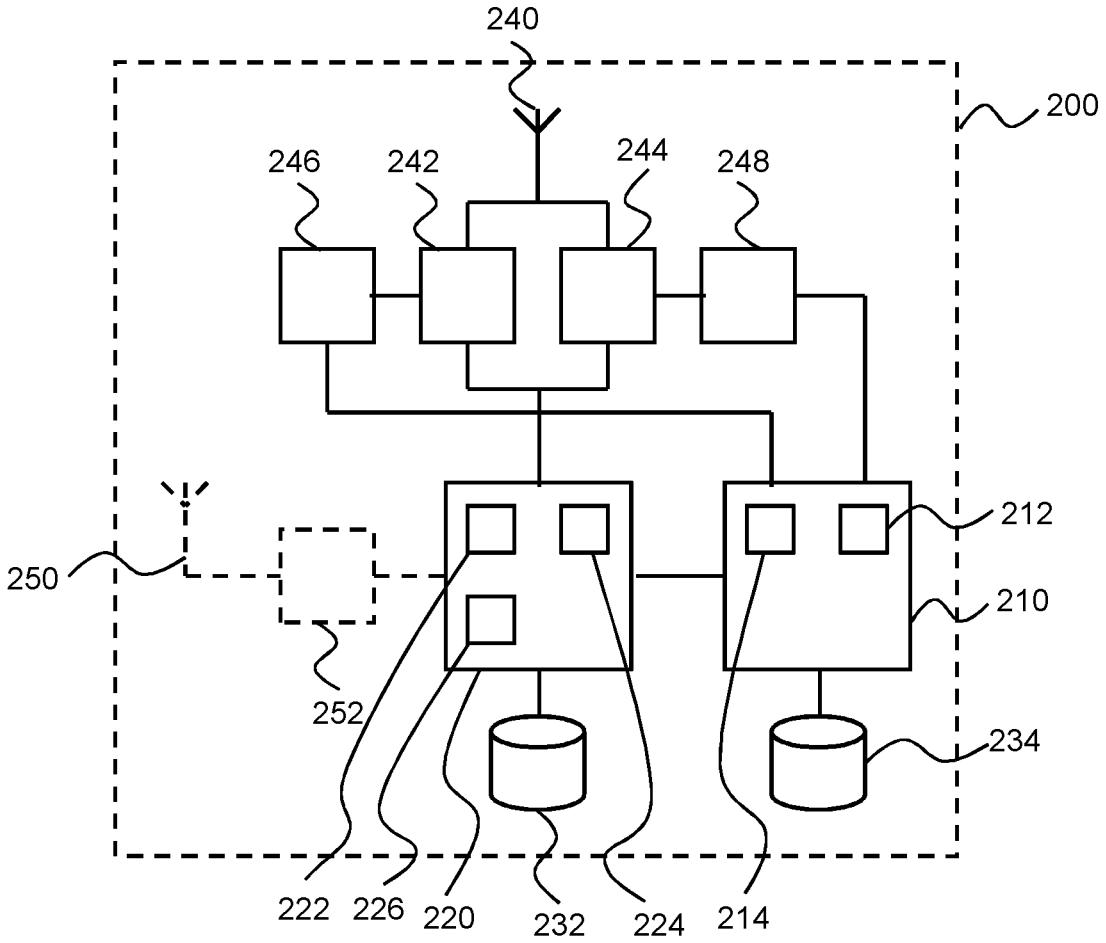
FIG. 2: shows a schematic view of a control module.
Figure 3:
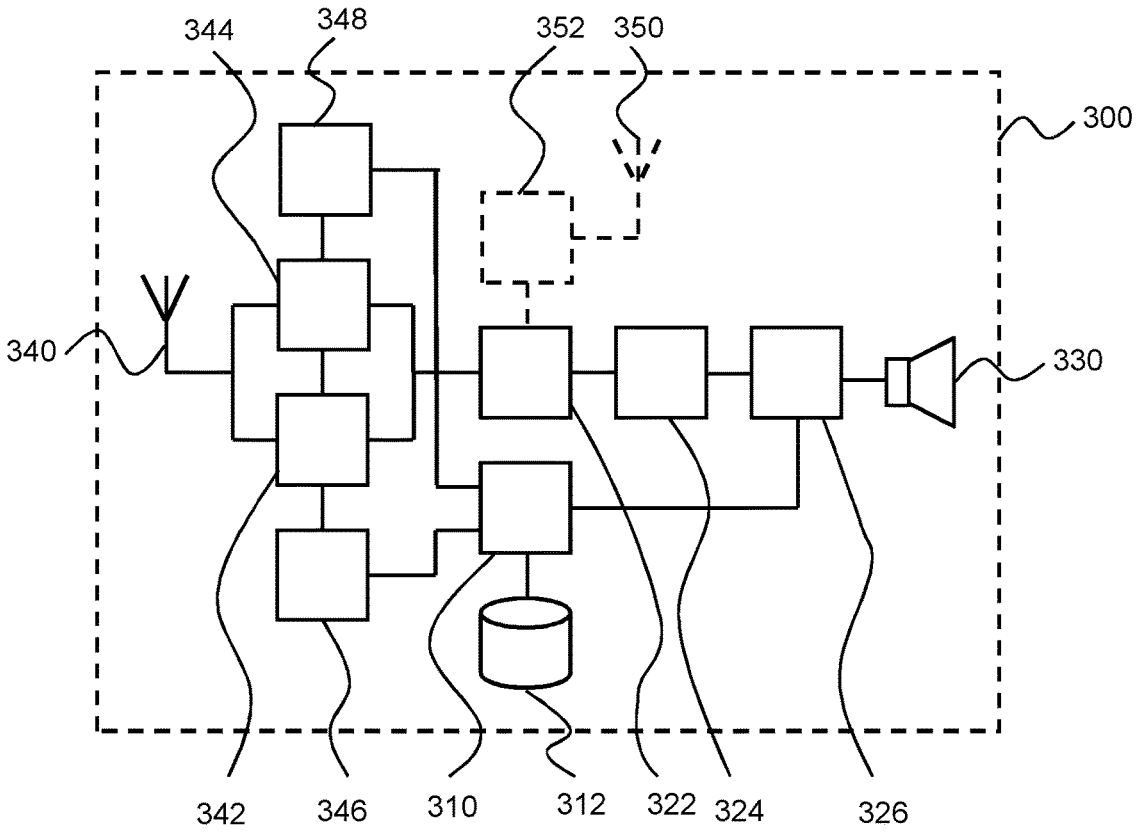
FIG. 3: shows a schematic view of a speaker module.

Assignment of functionality and further operation will be discussed by means of a first flowchart 500 shown by FIG. 5, a schematic view of a control module 200 shown by FIG. 2, a schematic view of a speaker module 300 as shown by FIG. 3 and a schematic view of a user device 400 shown by FIG. 4.

FIG. 2 shows a schematic view of a control module 200. The control module 200 comprises a central processing unit 210 for controlling operation of the control module 200 and at least part of the processes executed by control module 200. The central processing unit 210 comprises a distance determination sub-unit 212 and a function assignment sub-unit 214. The central processing unit 210 is coupled to an operating memory 234. The operating memory 234 is arranged for storing a computer programme product for programming the central processing unit 210 and other parts of the control module 200 to enable these parts to execute the various processes as discussed.

The control module 200 further comprises an audio processing unit 220. The audio processing unit 220 comprises an audio codec sub-unit 222, an audio adjustment sub-unit 224 and an audio assignment sub-unit 226. The audio processing unit 220 is coupled to a data memory 232. The data memory 232 is arranged for storing audio data to be processed by the audio processing unit 220 and the audio codec sub-unit 222 in particular.

The audio processing unit 220 and the central processing unit 210 may be provided as separate circuits or as one single circuit. The functionality of these units and their sub-units may be hard-wired or provided by programming the circuit or circuits by means of the computer programme products as discussed above. The operating memory 234 and the data memory 232 may be provided as volatile or non-volatile memories and as one single memory or two distinct memories. The memories may be provided as being part of the control module 200. Alternatively, the memories are provided at a remote location, operatively coupled to the control module 200 by means of a network like the internet.

The control module 200 further comprises a transmitter 242, a receiver 244, a transmission power measurement unit 246, a receiver power measurement unit 248 and an antenna 240. The transmitter 242 and the receiver 246 may be provided as distinct elements or as one transceiver circuit. Furthermore, the control module may comprise a data transceiver 252 coupled to a data antenna 250.

The control module 200 may be provided as part of a user device like a tablet computer or a telephone, held by a user at the user position 120. Alternatively, the control module 200 may be provided as part of the centre speaker 102 or the subwoofer 104. In yet another alternative, the control module 200 is provided as a separate module.

FIG. 3 shows the speaker module 300 comprises a central processing unit 310, for controlling at least part of the operation of the speaker module 300. The central processing unit is coupled to an operating memory 312. The operating memory 312 is arranged for storing a computer programme product for programming the central processing unit 310 and other parts of the speaker module 300 to enable these parts to execute the various processes as discussed.

The speaker module 300 further comprises an antenna 340, a receiver 344, a transmitter 342, a receiver power measurement unit 348, a transmitter power measurement unit 346, a buffer memory 322, a decoder module 324, an amplifier 326 and a speaker 330. Alternatively, the speaker 330 is provided separately from the speaker module 300 and the speaker module 300 is arranged to have the speaker 330 coupled to it. The speaker may be a speaker for high-frequency, mid frequency, low frequency or subwoofer sound reproduction—or a combination thereof. Specific characteristics may be stored in the operating memory 312, together with a unique identifier of the speaker module 300. Furthermore, the speaker module may comprise a data transceiver 352 coupled to a data antenna 350.

Figure 4:
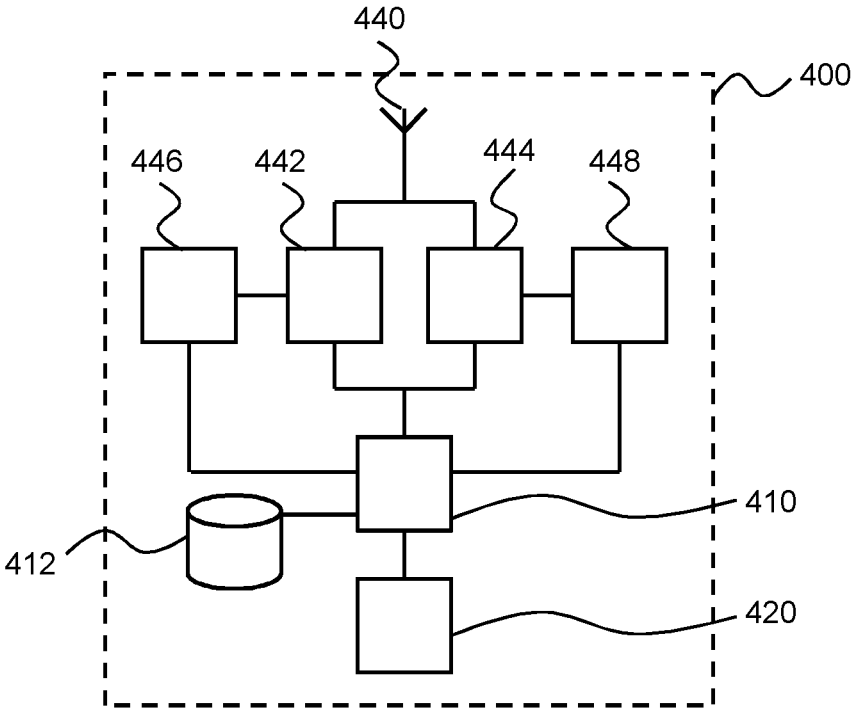
FIG. 4: shows a schematic view of a user device.
Figure 5:
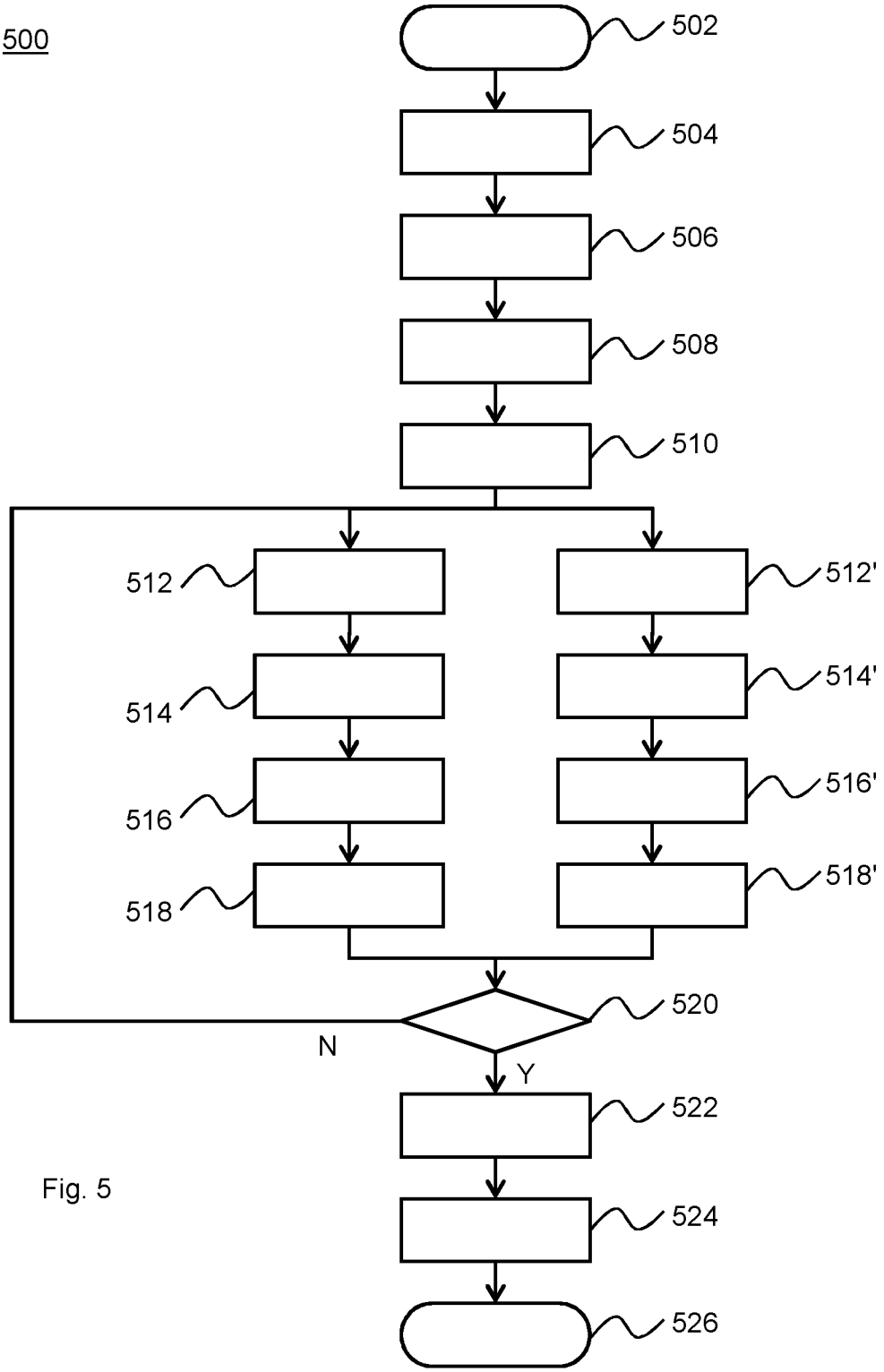
FIG. 5: shows a first flowchart.

FIG. 4 shows a schematic view of the user device 400. The user device 400 may be embodied as a smartphone or tablet computer, comprising far more elements and being arranged to provide functionality of the control module 200 as well. However, in FIG. 4, only parts most relevant for describing the embodiments discussed directly below are shown. The user device 400 comprises a central processing unit 410 coupled to an operating memory 412. The operating memory 412 is arranged for storing a computer programme product for programming the central processing unit 410 and other parts of the user device module 400 to enable these parts to execute the various processes as discussed. The central processing unit 410 also has a user interface module 420 coupled to it. The user interface module 420 may be a touch screen. Alternatively, hard-wired buttons are provided. The user device 400 further comprises an antenna 440, a receiver 444, a transmitter 442, a receiver power measurement unit 448 and a transmitter power measurement unit 446.

The functionality of the control module 200, the speaker module 300 and the user device 400 will now be further elucidated in conjunction with the first flowchart 500. The table directly below provides a short summary of each part of the flowchart 500. In the embodiments discussed here, a user carries a user device being arranged to send and receive a signal, preferably provided by means of an electromagnetic carrier in the GigaHertz range, though other ranges may be used as well. An example of such signal is a WiFi signal in accordance with the IEEE 801.11 standard—whereas other types of such signal may be envisaged as well. Examples of such signals may be Bluetooth, Zigbee, ANT, RFID/NFC or other. Preferably, wireless protocols relying on electromagnetic waves are used. And in the embodiments discussed here, the control module 200 is comprised by the subwoofer 104 (FIG. 1A).

502 initiate procedure
504 receive user device signal
506 determine sending power
508 determine receiving power
510 determine distance
512 receive speaker signal (at control module and user device)

514 determine sending power (at control module and user device)

516 determine receiving power (at control module and user device)

518 determine distance (to control module and user device)

520 check: all speaker devices done?

522 determine speaker locations

524 attribute functions to speakers

526 end procedure

The process starts in a terminator 502 by initialising the control module 200 and the speaker module 300. The procedure continues by the control module 200 receiving a signal from the user device 400 in step 504, by wireless transmission. The signal received may carry information on the power with which the signal was sent by the user device 400. In such embodiment, the signal sending power may be determined by means of the transmitter power measurement unit 446 of the user device 400. Alternatively or additionally, the signal is sent by the user device at a pre-determined power, a priori known by the control module 200. The sending power is thus determined by the central processing unit 210 of the control module 200 in step 506. The sending power of the signal such that the sending power at the sending location is determined. This does not mean the determination takes place at the sending location, but the power at that location is to be determined. This applies to the receiving power as well.

In step 508, the power of the signal received is determined. This is preferably done by means of the receiver power measurement unit 248 of the control module 200. The sending power and the power of the received signal are provided to the central processing unit 210 and to the distance determination sub-unit 212 in particular. From these numbers, a distance between the control module 200 and the user device 400 may be determined as a square root of the sending power divided by the receiving power, preferably multiplied by a pre-determined value. This action is performed in step 510. This approach is a theoretical approach; in practice another relation may hold due to environmental parameters. Such parameters may be the amount of reflection or absorption of electromagnetic waves by walls, furniture, people, other, or a combination thereof.

Subsequently, a signal of a satellite speaker, for example the first satellite speaker 106 (FIG. 1A) is received by the control module 200 in step 512 and by the user device 400 in step 512'. In step 514, the sending power for the signal from the first satellite speaker 106 is determined by the control module 200 in step 514. In step 514', the sending power for the signal from the first satellite speaker 106 is determined by the user device 400. In step 516, the power of the signal received from the first satellite speaker 106 by the control module is determined as discussed above. In step 516', the power of the signal received by the user device 400 from the first satellite speaker 106 is determined as discussed above. In step 518, the distance between the control module 200 and the first satellite speaker 106 is determined as discussed above. In step 518', the distance between the user device and the first satellite speaker 106 is determined as discussed above.

It is noted that in various embodiments, the signal for determining distances may be sent by any device: the first satellite speaker 106, the control module 200 or the user device 400. To determine distances, transmission of a signal between two members of the ensemble of the speaker system 100 and the user device 120 is to be established. Subsequently, transmission power parameters are determined and the sending power (power sent) and the receiving power (power received) as such parameters in particular.

The calculations on the distances may be performed locally by the user device 400, upon which the data on the distances is provided to the control module 200. Alternatively, only data on the power of the received signal or data on the received signal and the sending power are sent to the control module 200. Subsequently, the distance between the first satellite speaker 106 and the user device is determined by the control module 200. In yet another alternative, the first satellite speaker 106, embodied as the speaker module 300, receives signals from the control module 200 and the user device 400. Subsequently, the speaker module 300 determines the sending power of the signals received, the power of the signals received and subsequently the distances. Each of these steps may be performed by any of the modules where appropriate. In particular calculation of the distances may be performed by the distance determination sub-unit 212 of the control module 200. In such embodiment, data on sending power and received power is sent to the control module.

It is noted that a listener is supposed to carry the user device 400 or at least have it in his or her vicinity. So with distances to the user device 400, distances to the listener are presumed to have been determined.

Upon having determined distances between the user device 400, the control module 200 and the first satellite speaker 106 provided as an embodiment of the speaker module 300, steps 512 through 518 are repeated for other speaker modules that may be present in a system. This loop is initiated by decision 520. Having determined distances, positions of members of the system are determined.

In particular, locations of the members relative to one another are determined in step 522. First, the position of the subwoofer 104 with the control module 200 is determined as origin of a Euclidean space with—for example—Carthesian coordinates (0,0).

Subsequently, the position of the user device 400 (and with that, the position of the listener) is determined as (0,d1) with d1 being the distance between the listener and the subwoofer 104 comprising the control module 200. Alternatively, the location of the user device 400 is set as (0,0) and the position of the subwoofer 104 as (0,d1) - or (0,-d1), (d1,0) or (−d1,0), for that matter. d1 May be expressed in arbitrary units, metric units, other, or a combination thereof.

With these two locations known, the location of the first satellite speaker 106 as a speaker module 300 may be determined using the distance between the subwoofer 104 and the first satellite speaker and the distance between the user device 400 and the first satellite speaker 106 using a localisation method such as trilateration. With the data determining the location of the first satellite speaker 106 as first speaker module 300 addressed, it cannot be determined whether the first satellite speaker 106 is at the left side or the right side of the listener. Preferably, a default is selected. This default may later be changed by the listener, for example by means of the user device 400.

In this way, also locations of further satellite speakers may be determined in step 522. For any further satellite speaker, distances to three other members are determined. Such members may be the control module 200, the user device 400 or other speakers. With this data, the location of the further satellite speaker may be determined using a localisation method such as trilateration.

With locations of satellite speakers, the centre speaker 102, the subwoofer 104 and the user device 100 and with that, the location of the listener having been determined in step 522, functions are assigned to the satellite speakers in step 524. This may be done by the function assignment sub-unit 214. In a case as depicted by FIG. 1A, assigning functions to each satellite speaker is a straight forward exercise. The speaker left from the listener—who is defined as facing the subwoofer 104—farthest away from the subwoofer 104 is defined as left rear. The speaker left from the listener—who is defined as facing the subwoofer 104—closest to the subwoofer 104 is defined as left front. The speaker right from the listener—who is defined as facing the subwoofer 104—farthest away from the subwoofer 104 is defined as right rear. The speaker right from the listener—who is defined as facing the subwoofer 104—closest to the subwoofer 104 is defined as right front. And a speaker closest to the subwoofer 104 may be defined as a centre speaker.

Alternatively or additionally, other rules for assigning functionality may be envisaged as well. For assignment of functionality, specific characteristics of a speaker may be taken into account. Such characteristics, for example the speaker being a subwoofer or a tweeter, may be communicated while establishing transmission of a signal for determining distances. This data may be accompanied together with a unique identifier of each speaker module 300, if available. The list with identified speakers, their position data, their assigned functionality and other data if available may be stored in the operating memory 234. Having determined functionality of the speakers, the procedure ends in the terminator 526.

A specific case arises with two satellite speakers, the user device 400 providing functionality of the control module 200 and no subwoofer 104 in the system. In such system, distances between each speaker and the user device 400 are determined in accordance with procedures discussed above. Subsequently, one of the speakers is assigned as a right speaker and another speaker as left speaker. This may be done in a pre-determined way, randomly or by means of user input via the user interface module 420, other or a combination thereof. In this embodiment, relative locations are not required to be known as position data. Rather, distances between the user device 120 and each speaker suffices as position data for rendering of audio, as will become apparent from the remainder of this description.

In a system with multiple speakers and with the control module 200 being incorporated in the user device 400 instead of the subwoofer 104, the same procedure as discussed above may be executed, with processing taking place in the user device 400.

Figure 6:
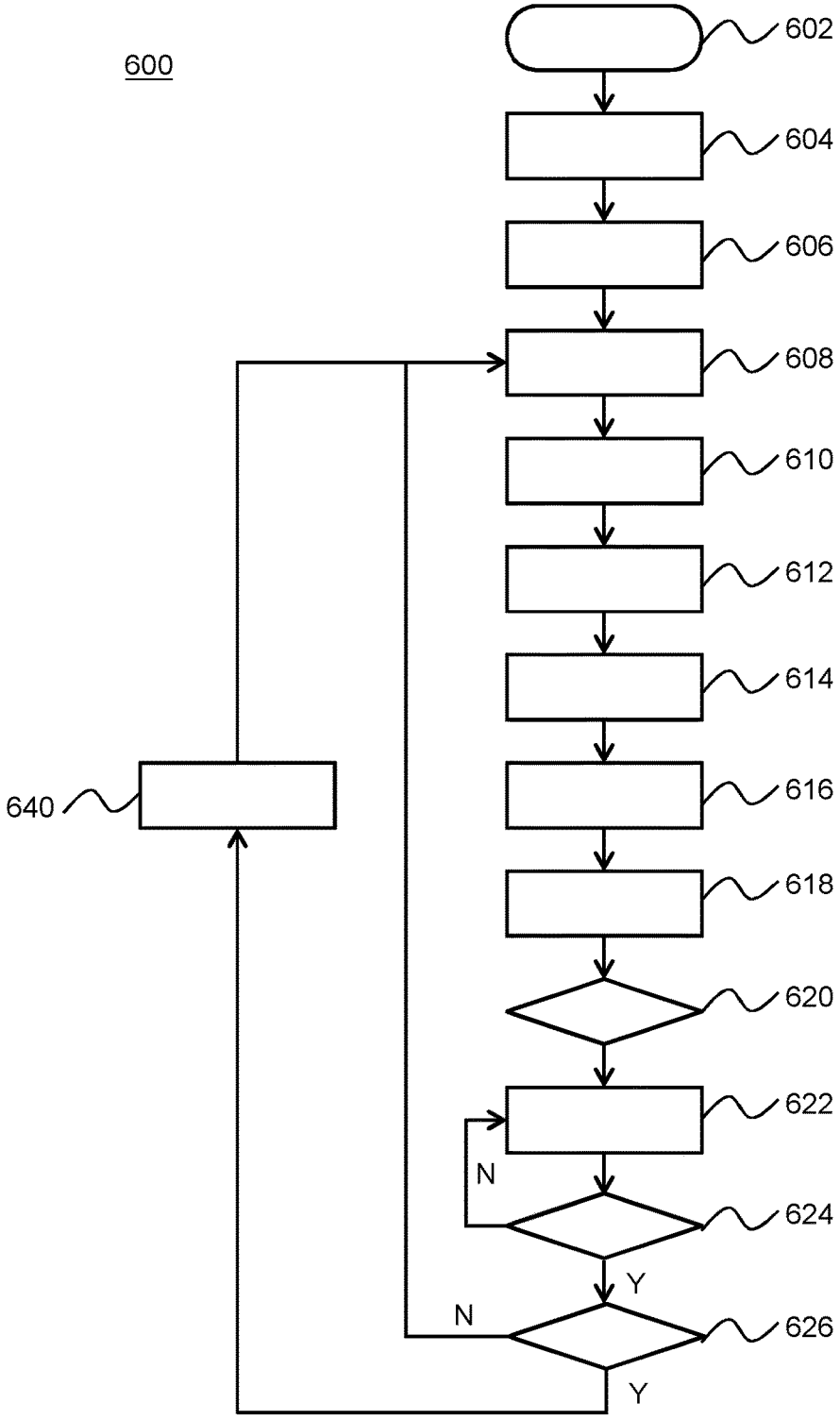
FIG. 6: shows a second flowchart.

Thus having determined positions and locations in particular of members of the speaker system 100 and the user device 120, the system is ready for rendering and reproducing audio data. Such audio data is preferably stored in the data memory 232 connected to the audio processing unit 220 of the control module 200. The data memory 232 does not necessarily have to be comprised by the control module 200. It can be located anywhere, as long as it is operatively connected to the audio processing unit 220. Playback of the audio data will be discussed in conjunction with FIG. 2, FIG. 3, FIG. 4 and the second flowchart 600 as depicted by FIG. 6. The table below provides short summaries of each part of the second flowchart 600.

602 initiate procedure

604 receive play back command

606 receive audio data

608 retrieve speaker list with functionality and position data

610 assign audio data to available speakers in accordance with functionality

612 receive user position

614 for each speaker, adjust audio in accordance with speaker and user position

616 provide adjusted audio data to corresponding speaker device

618 buffer audio data

620 decode audio data

622 render audio data

624 time to recalibrate and update user position data?

626 system hailed by new speaker device?

640 run initialisation procedure for new speaker

The process starts in a terminator 602 in which the speaker system 100 and the user device 120 are initialised for audio playback. In step 604, the control module 200 receives a playback command Such command is preferably received from the user device 400, which receives a user command by means of the user interface module 420. The user command is provided by the user device 400 to the control module 200 via wireless communication, using components as discussed above. Alternatively if the control module is incorporated in the user device 400, no wireless communication is required.

If the data to be reproduced by the speaker system 100 is stored on the user device 400, the data to be reproduced is sent to the control module 200. If the data to be reproduced is stored at another location, either a retrieve and playback command are sent to the control module 200 or data is retrieved by the user device 400 and forwarded to the control module, together with a playback command The audio data to be reproduced is received in step 606. This step, as indicated above, does not have to be distinct from step 604.

In step 608, a list with speakers of the speaker system 100 and their functionality as determined earlier is retrieved by the control module 200. Additionally, also position data comprising information on distances, locations, other position data or a combination thereof of the speakers may be retrieved.

With the audio data and a speaker list available, audio data is assigned to members of the speaker system 100 in step 610 by means of the audio assignment sub-unit 226. If audio data is available in stereo and the speaker system 100 comprises two members, the left channel of the audio data is sent to a left speaker and the right audio data is sent to a right speaker. If the audio data is available in a 5.1 format and the speaker system 100 comprises six speakers as discussed in conjunction with FIG. 1A, the six channels of the audio data received are directly forwarded to the corresponding speakers. If the audio data is available in a stereo format and the speaker system 100 comprises six speakers as discussed in conjunction with FIG. 1A, various algorithms are available for assigning audio data to each speaker for creating a 5.1 spatial sound image.

If the speaker system 100 comprises for example three speakers and a subwoofer, it may be that a left rear, a left front and a right speaker are defined. The right speaker may be defined to provide functionality of the right front and the right rear speaker. In such case, six channels of a 5.1 system may be created. The data for the subwoofer is provided to the subwoofer, data for the centre speaker are provided to all speakers, the data for the left front speaker to the left front speaker, the data for the left rear speaker to the left rear speaker and the data for the right rear speaker and for the right front speaker to the right speaker. Other way of processing audio data for compensating for a difference between the user device and various speakers may be envisaged as well.

In step 612, position data on the user device 400 is obtained. With this data, it is assumed the listener holds the user device 400 or is in the vicinity of the user device 400. The obtained position data on the user device may comprise information on distances between the user device 400 and two or more speakers of the speaker system 100. Alternatively or additionally, the position data provides information on a location of the user device 400 relative to the various members of the speaker system 100. This location may be expressed in Cartesian coordinates, as discussed above. In another embodiment, next to the position data of the user device 400, also position data related to various speaker modules 300 of the speaker system 100 may be updated.

Based on the position data received, audio data for at least one of the speakers is adjusted in step 614. In particular, volume of audio data to be reproduced is adjusted. The adjustment volume is preferably done such that independent from distance between the listener and a speaker, the listener always has a perception of being at a sweet spot of the speaker system 100, rather than being closer to one particular speaker than to other speakers. The audio adjustment may be performed by the audio adjustment sub-unit 224. Also the phase of the audio data may be adjusted to prevent audio waves from different speakers cancelling one another at the listener position.

Additionally or alternatively, audio data may be adjusted by delaying audio data to compensate for different distances between a determined listener position on one hand and speakers on the other hand. Audio data to be reproduced by one particular speaker close to the listener may be delayed relative to audio data to be reproduced by another particular speaker. More in detail, the delay operation is performed such that, for example, left audio data with a left timestamp value and right audio data with a right timestamp value arrives at the listener position with the left timestamp value and the right timestamp value being substantially equal—irrespective of the listener position relative to the one particular speaker and the other particular speaker. So processing audio data for compensating for a difference between the user device and various speakers may be done by adjusting audio data provided by separate speakers, and/or at an earlier stage by assigning specific parts of input data to one or more speakers—or a combination thereof. More specifically, the specific parts of input data may correspond with the channels, for example Centre, LF, RF, LR, RR, woofer, and may each be sent to one of the speakers, to which a corresponding functionality has been assigned, as described herein above.

It is noted that the audio data may be adjusted by directly adjusting audio data and providing adjusted data to a speaker in step 616 as one alternative. In another alternative, the audio data is adjusted by forwarding assigned audio data to a speaker module 300 together with control data in step 616. The control data is subsequently used for further local adjustment of the audio data in the speaker module 300. The audio data may be encoded or decoded before it is provided to one or more speaker modules 300. The audio data may be encrypted, decoded from a binary domain to an analogue domain, encoded from an analogue domain to a binary or otherwise digital domain or otherwise by the audio codec sub-unit 222.

The audio data, directly adjusted, provided with control data for further adjustment or as assigned by means of the audio assignment sub-unit 226 provided from the control module 200 to the speaker module 300 by means of wireless data transmission. Preferably, the transmitter 242 of the control module 200 and the receiver 344 of the speaker module 300 are used for transmission of audio data from the control module 200 to the speaker module. As the transmitter 242 of the control module 200 and the receiver 344 of the speaker module 300 are also used for determining distances between various modules, audio data is preferably provided in bursts. This enables to interleave transmission of audio data with transmission for determining distances.

Alternatively, the data transceiver 252 of the control module and the data transceiver 352 of the speaker module are used as separate components. Using additional transmitting and receiving components enables an option of sending audio data in a continuous way. Such continuous transmission may be required when sending audio data in the analogue domain. Furthermore, data transmission and distance and position determination may be executed using different protocols. If such is the case, separate transceiver units and/or antenna's may be preferred. These separate transceiver unit may still be part of one communication module. Communication modules having both 802.11 and Bluetooth communication capabilities are known in the market.

In the speaker module 300, audio data is received by means of the antenna 340 and the receiver 344. The audio data received may be buffered by the buffer memory 322 in step 618. This is particularly advantageous with audio data received is in the digital (binary) domain. The option of buffering enables sending and receiving of audio data to be interleaved with transmission of data for measurement purposes. Buffered data may be decoded, for example from a digital to an analogue domain in step 620, by the decoder module 324. The decoded audio data is subsequently rendered and in particular amplified by means of the amplifier 326 in step 622. In case the audio data is provided with volume control data as discussed above, this control data is processed during the rendering step by amplifying the audio data at a level as indicated by the volume control data. The amplified data is subsequently provided to the speaker 330 for reproduction.

While the reproduction of the audio data is running, the speaker system 100 is recalibrated regularly. In particular, position data for the user device 400 and the speaker modules 300 is updated regularly. In decision 624 is checked whether it is time for recalibration. If not, the process branches back to step 622 and continues with rendering audio data for reproduction by the speaker 330.

If recalibration is required, for example because a timer has lapsed or in response to an interrupt, the process checks whether the control module 200 detects a speaker module that is not yet a member of the speaker system 100. Such detection may be done by hailing speaker modules 300 regularly. Alternatively or additionally, speaker modules are able to commence a hailing procedure themselves. If a new speaker module 300 is detected, the initialisation procedure as depicted by the first flowchart 500 may be executed. If no new speaker module 300 is detected, branches back to step 608 for updating position data with an updated listener position and/or updated positions of speaker modules 300. As indicated, position data to be updated may relate to the user device 400, any speaker module 300 or a combination thereof.

The rendering and reproduction process may be ended upon a user—usually the listener—commands pausing or terminating of the playback process. This may be done by means of the user interface module 420.

From the description above, it will be apparent that various functionalities described may be performed by various components of the ensemble of the speaker system 100 and the user device 400. In particular the components of the control module, either from a physical point of view or a functional point of view, may be comprised by the speaker module 300 or the user device 400.

From the functional point of view, the incorporation of functionality of the control module 200 may be performed by programming the central processing of the device.

If incorporated in the speaker module 300, incorporation in a speaker module 300 having subwoofer functionality is preferred. A reason for this is that a subwoofer speaker is usually a heavy device that is not often moved by a user. This enables the subwoofer to provide a fixed point in the Euclidian space as described above and this, in turn, allows other speakers (speaker modules) of the speaker system 100 to be placed freely. And as another alternative, the control module 200 may be provided as a separate entity.

In summary, the various aspects relate to a system comprising multiple speakers and a control unit. The speakers and the control unit are arranged to locate one another and to determine distances and preferably locations relative to one another, for example based on signal power measurements. Also a user position may be determined via a device close to the user, like a telephone or a watch. This information is used for processing audio data for rendering for optimal user experience. Based on locations of speakers relative to the user, dedicated functionality may be assigned to a speaker. The audio data to be reproduced may be processed and at least parts thereof may be assigned to a speaker, depending on the assigned functionality. Speaker modules may be added and assigned a functionality on the go. Capability for processing of audio and position data may be performed by any of a user device, speaker module or dedicated control module.

Expressions such as "comprise", "include", "incorporate", "contain", "is" and "have" are to be construed in a non-exclusive manner when interpreting the description and its associated claims, namely construed to allow for other items or components which are not explicitly defined also to be present. Reference to the singular is also to be construed in be a reference to the plural and vice versa. When data is being referred to as audiovisual data, it can represent audio only, video only or still pictures only or a combination thereof, unless specifically indicated otherwise in the description of the embodiments.

A computer programme product as referred to, comprising computer executable code, may be implemented in source code, object code, machine code or any other form that may be required to be compiled before execution, either before or during runtime. The computer programme product may be embodied as a volatile memory, a non-volatile memory like a hard disk, a flash drive or tape or another medium with a signal carrying information comprising the computer executable code. In the description above, it will be understood that when an element such as layer, region or substrate or components of a system are referred to as being "on", "onto" or "connected to" another element, the element is either directly on or connected to the other element, or intervening elements may also be present.

Furthermore, the invention may also be embodied with less components than provided in the embodiments described here, wherein one component carries out multiple functions. Just as well may the invention be embodied using more elements than depicted in the Figures, wherein functions carried out by one component in the embodiment provided are distributed over multiple components.

A person skilled in the art will readily appreciate that various parameters disclosed in the description may be modified and that various embodiments disclosed and/or claimed may be combined without departing from the scope of the invention.

The invention claimed is:

1. In a system comprising a first speaker device, a second speaker device and a control module, a method of processing audio data, comprising:

Determining first position data of the first speaker device;

Determining second position data of the second speaker device;

Based on the first position data, determining a first distance between a user device and the first speaker device;

Based on the second position data, determining a second distance between the user device and the second speaker device;

Receiving first audio data for reproduction by the first speaker device;

Receiving second audio data for reproduction by the second speaker device;

Processing the first audio data and the second audio data by adjusting at least one of the first audio data and the second audio data for compensating for a difference between the first distance and the second distance;

Providing the processed first audio data to the first speaker device for reproduction; and Providing the processed second audio data to the second speaker device for reproduction CHARACTERISED BY Receiving at least the first and second audio data and determining the first and second position data using different protocols, Using as the protocol used for determining the first and second position data a short range communication protocol, such as BlueTooth, to detect a user device coming into or moving out of sound range of a speaker device;

Activating the speaker device, when the user device is detected to have come into sound range of the speaker device and de-activating the speaker device, when the user device moves out of sound range relative to the speaker device;

Establishing transmission of a first signal between the first speaker device and the control module;

Establishing transmission of a second signal between the second speaker device and the control module;

Determining a first signal sending power of the first signal at the sending location of the first signal;

Determining a second signal sending power of the second signal at the sending location of the second signal;

Determining a first signal receiving power of the first signal at the receiving location of the first signal;

Determining a second signal receiving power of the second signal at the receiving location of the second signal;

Determining at least part of the first position data by determining a third distance between the control module and the first speaker device based on the first signal sending power and the first signal receiving power; and Determining at least part of the second position data by determining a fourth distance between the control module and the second speaker device based on the second signal sending power and the second signal receiving power.

2. Method according to claim 1, further comprising, based on the position data of the first speaker device, of the second speaker device and of at least one of the user device and the control module, assigning a dedicated functionality to the first speaker device and to the second speaker device, and sending said parts of input data to each of the first speaker device and the second speaker device, wherein said parts of the input data correspond with the assigned dedicated functionality.

3. Method according to claim 1, wherein the protocol for transmitting at least the first and second audio data is based on the WiFi standard 802.11.

4. Method according to claim 1, further comprising transmitting the first and second position data using the same protocol as the first and second audio data.

5. Method according to claim 1, further comprising:

For one or more members of the system and the user device, establishing transmission of at least one further signal between the component and at least one further component;

Determining a further signal sending power of the further signal at the sending location of the further signal;

Determining a further signal receiving power of the further signal at the receiving position of the further signal;

Determining a further distance based on the further signal sending power and the further signal receiving power; the further distance being between the component and the further component between which the transmission has been established;

For one or more members of the system and the user device, based on distances between the one or more members of the system and the user device on one hand and at least two further members of the system and the user device on the other hand, determining further position data on relative positions of the one or more members of the system and the user device relative to other components of the system.

6. Method according to claim 5, wherein the determined further position data comprises data on distances between one or more components of the system relative to at least one other component of the system or the user device.

7. Method according to claim 1, comprising determining, for one or more of the members of the system and the user device, distances between one or more components on one hand and at least three further components of the other hand, wherein the determined further position data for each component comprise data on locations of each component of the system relative to at least one other component of the system.

8. Method according to claim 5, wherein position data on relative positions are determined for each component.

9. Method according to claim 1, further comprising:

Determining a user device distance between the user device and the control module or a third speaker device;

Determining a user-speaker distance between the user device and at least one of the first speaker device and the second speaker device;

Determining a control-speaker distance between the user device and at least one of the first speaker device and the second speaker device; and Determining positions of the user device, the control module or the third speaker and at least one of the first speaker device and the second speaker device relative to one another.

10. Method according to claim 1, wherein processing the first audio data and the second audio data comprises adjusting a volume of at least one of the first audio data and the second audio data such that if the first audio data and the second audio data were to have the same signal, a first sound power level of sound originating from the first speaker device is substantially equal to a second sound power level of sound originating from the second speaker device at a position of the user device.

11. Method according to claim 1, wherein processing the first audio data and the second audio data comprises delaying rendering of at least one of the first audio data and the second audio data such that sound corresponding to a first segment of the first audio data having a first timestamp having a first value arrives at the position of the user device at substantially the same moment as a second segment of the second audio data having a first timestamp having a second value, the second value being substantially equal to the first value.

12. Method according to claim 1, wherein:

The first position data related to the first speaker device comprises data related to the first distance; and The second position data related to the second speaker device comprises data related to the second distance.

13. Method according to claim 1, wherein:

The first position data related to the first speaker device comprises coordinates of a first location of the first speaker device relative to an origin; and The second position data related to the second speaker device comprises coordinates of a second location of the second speaker device relative to the origin.

14. Processing device for a system for processing audio data, comprising:

A communication module arranged to:

Receive first position data related to the first speaker device;

Receive second position data related to the second speaker device;

Receive first audio data for reproduction by the first speaker device;

Receive second audio data for reproduction by the second speaker device;

A processing module arranged to:

Based on the first position data, determine a first distance between a user device and the first speaker device;

Based on the second position data, determine a second distance between the user device and the second speaker device;

Process the first audio data and the second audio data by adjusting at least one of the first audio data and the second audio data for compensating for a difference between the first relative distance and the second relative distance;

The communication module being further arranged to:

Provide the processed first audio data to the first speaker device for reproduction; and Provide the processed second audio data to the second speaker device for reproduction CHARACTERISED IN THAT the communication module is configured to transmit at least the first and second audio data and to determine the first and second position data using different protocols, and to use as the protocol used for determining the first and second position data a short range communication protocol, such as BlueTooth, for the processing module to Detect a user device coming into or moving out of sound range of a speaker device; and Activate the speaker device, when the user device is detected to have come into sound range of the speaker device and de-activate the speaker device, when the user device moves out of sound range relative to the speaker device, wherein the communication module is arranged to:

Establish transmission of a first signal between the first speaker device and the control module; and Establish transmission of a second signal between the second speaker device and the control module; and Wherein the processing module is arranged to:

Determine a first signal sending power of the first signal at the sending location of the first signal;

Determine a second signal sending power of the second signal at the sending location of the second signal;

Determine a first signal receiving power of the first signal at the receiving position of the first signal;

Determine a second signal receiving power of the second signal at the receiving position of the second signal;

Determine at least part of the first position data by determining a first distance between the control module and the first speaker device based on the first signal sending power and the first signal receiving power; and Determine at least part of the second position data by determining a second distance between the control module and the second speaker device based on the second signal sending power and the second signal receiving power.

15. Processing device according to claim 14, wherein the processing device is comprised by the user device.

16. A computer-readable medium storing computer executable code enabling a processor of a computer, when the code is loaded into the processor, to execute the method according to claim 1, wherein the computer-readable medium is volatile memory, non-volatile memory, flash drive or tape.

* * * * *